US011326834B2

(12) United States Patent
Ryberg et al.

(10) Patent No.: US 11,326,834 B2
(45) Date of Patent: May 10, 2022

(54) CONSERVING MIXED REFRIGERANT IN NATURAL GAS LIQUEFACTION FACILITIES

(71) Applicant: ExxonMobil Upstream Research Company, Spring, TX (US)

(72) Inventors: Brett L. Ryberg, The Woodlands, TX (US); Stephen Wright, Georgetown, TX (US); Kenichi Tadano, Yokohama (JP); Naoki Watanabe, Yokohama (JP)

(73) Assignee: ExxonMobil Upstream Research Company, Spring, TX (US)

( * ) Notice: Subject to any disclaimer, the term of this patent is extended or adjusted under 35 U.S.C. 154(b) by 273 days.

(21) Appl. No.: 16/519,824

(22) Filed: Jul. 23, 2019

(65) Prior Publication Data

US 2020/0056839 A1 Feb. 20, 2020

Related U.S. Application Data

(60) Provisional application No. 62/718,738, filed on Aug. 14, 2018.

(51) Int. Cl.
*F25J 1/02* (2006.01)
*F25J 3/04* (2006.01)

(52) U.S. Cl.
CPC ..... *F25J 1/0248* (2013.01); *F25J 3/04563* (2013.01); *F25J 2260/42* (2013.01);
(Continued)

(58) Field of Classification Search
CPC .. F25J 1/02; F25J 1/0025; F25J 1/0244; F25J 1/0245; F25J 1/0248; F25J 1/0249;
(Continued)

(56) References Cited

U.S. PATENT DOCUMENTS 1,914,337 A 6/1933 Belt
1,974,145 A 9/1934 Atwell ..... 183/120
(Continued)

FOREIGN PATENT DOCUMENTS

CN 102628635 10/2014 ..... F25J 3/08
CN 103383172 2/2016
(Continued)

OTHER PUBLICATIONS

U.S. Appl. No. 15/347,968, filed Nov. 10, 2016, Pierre, Fritz Jr. et al.

(Continued)

*Primary Examiner* — Jianying C Atkisson
*Assistant Examiner* — Erik Mendoza-Wilkenfel
(74) *Attorney, Agent, or Firm* — ExxonMobil Upstream Research Company—Law Department

(57) ABSTRACT

A method of operating, during an at least partial shutdown of a refrigerant distribution subsystem in a natural gas liquefaction facility, can include: draining down at least a portion of a mixed refrigerant in one or more components of the refrigerant distribution subsystem into a high-pressure holding tank of a drain down subsystem, wherein draining down to the high-pressure holding tank is achieved by pumping the mixed refrigerant from the refrigerant distribution subsystem to the high-pressure holding tank or backfilling the refrigerant distribution subsystem with a backfill gas; and optionally, transferring at least a portion of the mixed refrigerant into a low-pressure drum from the high-pressure holding tank.

13 Claims, 3 Drawing Sheets

(52) U.S. Cl.
CPC ..... *F25J 2280/20* (2013.01); *F25J 2290/62* (2013.01); *F25J 2290/90* (2013.01)

(58) Field of Classification Search
CPC .... F25J 1/0251; F25J 2280/20; F25J 2280/30; F25J 2210/90; F25J 2270/66; F25B 2345/002; F25B 2345/004
See application file for complete search history.

(56) References Cited

U.S. PATENT DOCUMENTS

| | | | | |
|---|---|---|---|---|
| 2,007,271 | A | 7/1935 | Frankl | 62/175.5 |
| 2,011,550 | A | 8/1935 | Hasche | 62/121 |
| 2,321,262 | A | 6/1943 | Taylor | 62/140 |
| 2,475,255 | A | 7/1949 | Rollman | 62/170 |
| 2,537,045 | A | 1/1951 | Garbo | 62/122 |
| 3,014,082 | A | 12/1961 | Woertz | 260/676 |
| 3,103,427 | A | 9/1963 | Jennings | 62/39 |
| 3,180,709 | A | 4/1965 | Yendall et al. | 23/210 |
| 3,347,055 | A | 10/1967 | Blanchard et al. | 62/9 |
| 3,370,435 | A | 2/1968 | Arregger | 62/28 |
| 3,400,512 | A | 9/1968 | McKay | 55/69 |
| 3,400,547 | A | 9/1968 | Williams et al. | 62/55 |
| 3,511,058 | A | 5/1970 | Becker | 62/9 |
| 3,724,226 | A | 4/1973 | Pachaly | 62/39 |
| 3,855,810 | A | 12/1974 | Simon et al. | |
| 3,878,689 | A | 4/1975 | Grenci | 62/9 |
| 4,281,518 | A | 8/1981 | Muller et al. | 62/12 |
| 4,415,345 | A | 11/1983 | Swallow | 62/28 |
| 4,609,388 | A | 9/1986 | Adler et al. | 62/12 |
| 4,769,054 | A | 9/1988 | Steigman | 62/12 |
| 5,024,061 | A * | 6/1991 | Pfeil, Jr. | F25B 45/00 62/292 |
| 5,025,860 | A | 6/1991 | Mandrin | 166/267 |
| 5,137,558 | A | 8/1992 | Agrawal | 62/24 |
| 5,139,547 | A | 8/1992 | Agrawal et al. | 62/8 |
| 5,141,543 | A | 8/1992 | Agrawal et al. | 62/8 |
| 5,636,529 | A * | 6/1997 | Schmidt | F25J 1/0022 62/613 |
| 5,638,698 | A | 6/1997 | Knight et al. | 62/632 |
| 5,950,453 | A | 9/1999 | Bowen et al. | 62/612 |
| 6,003,603 | A | 12/1999 | Breivik et al. | 166/357 |
| 6,158,242 | A | 12/2000 | Lu | 62/637 |
| 6,295,838 | B1 | 10/2001 | Shah et al. | 62/643 |
| 6,298,688 | B1 | 10/2001 | Brostow et al. | 62/613 |
| 6,412,302 | B1 | 7/2002 | Foglietta | 62/611 |
| 6,553,772 | B1 | 4/2003 | Belanger et al. | |
| 6,662,589 | B1 | 12/2003 | Roberts et al. | 62/425 |
| 6,889,522 | B2 | 5/2005 | Prible et al. | 62/612 |
| 7,143,606 | B2 | 12/2006 | Trainer | 62/611 |
| 7,278,281 | B2 | 10/2007 | Yang et al. | 62/612 |
| 7,386,996 | B2 | 6/2008 | Fredheim et al. | 62/612 |
| 7,520,143 | B2 | 4/2009 | Spilsbury | 62/620 |
| 7,712,331 | B2 | 5/2010 | Dee et al. | 62/612 |
| 8,079,321 | B2 | 12/2011 | Balasubramanian | 114/74 |
| 8,435,403 | B2 | 5/2013 | Sapper et al. | 208/254 |
| 8,464,289 | B2 | 6/2013 | Pan | 725/34 |
| 8,601,833 | B2 | 12/2013 | Dee et al. | 62/648 |
| 8,616,012 | B2 | 12/2013 | Duerr et al. | 62/89 |
| 8,747,520 | B2 | 6/2014 | Bearden et al. | 95/41 |
| 9,016,088 | B2 | 4/2015 | Butts | 62/613 |
| 9,163,564 | B2 | 10/2015 | Hottovy | |
| 9,339,752 | B2 | 5/2016 | Reddy et al. | B01D 53/002 |
| 9,435,229 | B2 | 9/2016 | Alekseev et al. | 60/643 |
| 9,439,077 | B2 | 9/2016 | Gupta et al. | H04W 12/12 |
| 9,459,042 | B2 | 10/2016 | Chantant et al. | 62/50.2 |
| 2006/0000615 | A1 | 1/2006 | Choi | 166/352 |
| 2007/0277674 | A1 | 12/2007 | Hirano et al. | 95/290 |
| 2009/0217701 | A1 | 9/2009 | Minta et al. | 62/612 |
| 2009/0241593 | A1 * | 10/2009 | Jager | F25J 1/0291 62/613 |
| 2010/0192626 | A1 | 8/2010 | Chantant | 62/606 |
| 2010/0251763 | A1 | 10/2010 | Audun | 62/614 |
| 2011/0036121 | A1 | 2/2011 | Roberts et al. | 62/612 |
| 2011/0126451 | A1 | 6/2011 | Pan et al. | 44/451 |
| 2011/0259044 | A1 | 10/2011 | Baudat et al. | 62/611 |
| 2012/0285196 | A1 | 11/2012 | Flinn et al. | 62/620 |
| 2013/0074541 | A1 | 3/2013 | Kaminsky et al. | 62/601 |
| 2013/0199238 | A1 | 8/2013 | Mock et al. | 62/611 |
| 2014/0130542 | A1 | 5/2014 | Brown et al. | 62/612 |
| 2015/0285553 | A1 | 10/2015 | Oelfke et al. | 62/611 |
| 2017/0010041 | A1 | 1/2017 | Pierre, Jr. et al. | 62/616 |
| 2017/0016667 | A1 | 1/2017 | Huntington et al. | 62/614 |
| 2017/0016668 | A1 | 1/2017 | Pierre, Jr. et al. | 62/614 |
| 2017/0160010 | A1 | 6/2017 | Kenefake et al. | |

FOREIGN PATENT DOCUMENTS

| | | | |
|---|---|---|---|
| DE | 1960515 | 5/1971 | F25J 1/02 |
| DE | 2354726 | 5/1975 | F17C 9/04 |
| DE | 3149847 | 7/1983 | B01D 5/00 |
| DE | 19906602 | 8/2000 | F25J 3/08 |
| DE | 102013007208 | 10/2014 | B01D 3/14 |
| EP | 1715267 | 10/2006 | F25J 3/02 |
| EP | 1972875 | 9/2008 | F25J 3/04 |
| EP | 2157013 | 8/2009 | F17C 3/02 |
| EP | 2629035 | 8/2013 | F25J 1/00 |
| EP | 3006874 | 1/2019 | |
| FR | 2756368 | 5/1998 | B01D 53/26 |
| GB | 1376678 | 12/1974 | F25J 1/02 |
| GB | 1596330 | 8/1981 | F25J 1/02 |
| GB | 2172388 | 9/1986 | E21B 43/16 |
| GB | 2333148 | 7/1999 | F25J 1/02 |
| GB | 2470062 | 11/2010 | F25J 1/02 |
| GB | 2486036 | 11/2012 | F25J 1/02 |
| JP | 57169573 | 10/1982 | |
| JP | 59216785 | 12/1984 | F25J 1/02 |
| JP | 2530859 | 4/1997 | G02F 1/13 |
| JP | 5705271 | 11/2013 | F25J 3/00 |
| JP | 5518531 | 6/2014 | Y02P 20/152 |
| KR | 2010/0112708 | 10/2010 | F17C 5/00 |
| KR | 2011/0079949 | 7/2011 | F25J 3/02 |
| WO | WO2006/120127 | 11/2006 | F25J 3/02 |
| WO | 2007008453 | 1/2007 | |
| WO | WO2008/133785 | 11/2008 | B63B 25/08 |
| WO | WO2011/101461 | 8/2011 | B63B 25/16 |
| WO | WO2012/031782 | 3/2012 | F25J 1/02 |
| WO | WO2014/048845 | 4/2014 | F25J 1/00 |
| WO | WO2015/110443 | 7/2015 | F25J 1/00 |
| WO | WO2017/011123 | 1/2017 | F25J 3/08 |
| WO | WO2017/067871 | 4/2017 | F01D 15/10 |

OTHER PUBLICATIONS

U.S. Appl. No. 15/347,983, filed Nov. 10, 2016, Pierre, Fritz Jr. et al.
U.S. Appl. No. 15/348,004, filed Nov. 10, 2016, Pierre, Fritz Jr. et al.
U.S. Appl. No. 15/348,533, filed Nov. 10, 2016, Pierre, Fritz Jr.
U.S. Appl. No. 62/458,127, filed Feb. 13, 2017, Pierre, Fritz Jr.
U.S. Appl. No. 62/458,131, filed Feb. 13, 2017, Pierre, Fritz Jr.
U.S. Appl. No. 62/463,274, filed Feb. 24, 2017, Kaminsky, Robert D. et al.
U.S. Appl. No. 62/478,961, Balasubramanian, Sathish.
Bach, Wilfried (1990) "Offshore Natural Gas Liquefaction with Nitrogen Cooling—Process Design and Comparison of Coil-Wound and Plate-Fin Heat Exchangers," *Science and Technology Reports*, No. 64, Jan. 1, 1990, pp. 31-37.
Chang, Ho-Myung et al., (2019) "Thermodynamic Design of Methane Liquefaction System Based on Reversed-Brayton Cycle" Cryogenics, pp. 226-234.
ConocoPhillips Liquefied Natural Gas Licensing (2017) "Our Technology and Expertise Are Ready to Work Toward Your LNG Future Today," http://lnglicensing.conocophilips.com/Documents/15-1106%LNG%Brochure_March2016.pdf, Apr. 25, 2017, 5 pgs.
Danish Technologies Institute (2017) "Project—Ice Bank System with Pulsating and Flexible Heat Exchanger (IPFLEX)," https://www.dti.dk/projects/project-ice-bank-system-with-pulsating-andexible-heat-exchanger-ipflex/37176.
Diocee, T. S. et al. (2004) "Atlantic LNG Train 4-The Worlds Largest LNG Train", *The 14th International Conference and Exhi-*

(56) References Cited

OTHER PUBLICATIONS

*bition on Liquefied Natural Gas* (*LNG 14*), Doha, Qatar, Mar. 21-24, 2004, 15 pgs.
Khoo, C. T et al. (2009) "Execution of LNG Mega Trains—The Qatargas 2 Experience," *WCG*, 2009, 8 pages.
Laforte, C. et al. (2009) "Tensile, Torsional and Bending Strain at the Adhesive Rupture of an Iced Substrate," *ASME 28th Int'l Conf, on Ocean, Offshore and Arctic Eng*., OMAE2009-79458, 8 pgs.
Mclachlan, Greg (2002) "Efficient Operation of LNG From the Oman LNG Project," *Shell Global Solutions International B.V*., Jan. 1, 2002, pp. 1-8.
Olsen, Lars et al. (2017).
Ott, C. M. et al. (2015) "Large LNG Trains: Technology Advances to Address Market Challenges", *Gastech*, Singapore, Oct. 27-30, 2015, 10 pgs.
Publication No. 43031 (2000) Research Disclosure, Mason Publications, Hampshire, GB, Feb. 1, 2000, p. 239, XP000969014, ISSN: 0374-4353, paragraphs [0004], [0005] & [0006].
Publication No. 37752 (1995) Research Disclosure, Mason Publications, Hampshire, GB, Sep. 1, 1995, p. 632, XP000536225, ISSN: 0374-4353, 1 page.
Ramshaw, Ian et al. (2009) "The Layout Challenges of Large Scale Floating LNG," *ConocoPhillips Global LNG Collaboration*, 2009, 24 pgs, XP009144486.
Riordan, Frank (1986) "A Deformable Heat Exchanger Separated by a Helicoid," *Journal of Physics A: Mathematical and General*, v. 19.9, pp. 1505-1515.
Roberts, M. J. et al. (2004) "Reducing LNG Capital Cost in Today's Competitive Environment", PS2-6, *The 14th International Conference and Exhibition on Liquefied Natural Gas* (*LNG 14*), Doha, Qatar, Mar. 21-24, 2004, 12 Pgs.
Shah, Pankaj et al. (2013) "Refrigeration Compressor Driver Selection and Technology Qualification Enhances Value for the Wheatstone Project," *17th Int'l Conf. & Exh. On LNG*, 27 pgs.
Tan, Hongbo et al. (2016) "Proposal and Design of a Natural Gas Liquefaction Process Recovering the Energy Obtained from the Pressure Reducing Stations of High-Pressure Pipelines," *Cryogenics*, Elsevier, Kidlington, GB, v.80, Sep. 22, 2016, pp. 82-90.
Tsang, T. P. et al. (2009) "Application of Novel Compressor/Driver Configuration in the Optimized Cascade Process," *2009 Spring Mtg. and Global Conf. on Process Safety-9th Topical Conf, on Gas Utilization*, 2009, Abstract, 1 pg. https://www.aiche.org/conferences/aiche-sping-meeting-and-globalcongress- on-process-safety/2009/proceeding/paper/7a-application-novel-compressordriver-configurationoptimized-cascader-process.

* cited by examiner

CONSERVING MIXED REFRIGERANT IN NATURAL GAS LIQUEFACTION FACILITIES

CROSS REFERENCE TO RELATED APPLICATION

This application claims the priority benefit of United States Provisional Patent Application No. 62/718,738 filed Aug. 14, 2018, entitled CONSERVING MIXED REFRIGERANT IN NATURAL GAS LIQUEFACTION FACILITIES.

FIELD

This disclosure relates generally to systems and methods for conserving mixed refrigerant during drain down operations of a refrigerant distribution subsystem in a natural gas liquefaction facility.

BACKGROUND

Because of its clean burning qualities and convenience, natural gas has become widely used in recent years. However, large volumes of natural gas, primarily methane, are located in remote areas of the world. This gas has significant value if it can be economically transported to market. Where gas reserves are located in reasonable proximity to a market and the terrain between the two locations permits, the gas is typically produced and then transported to market through submerged and/or land-based pipelines. However, when gas is produced in locations where laying a pipeline is infeasible or economically prohibitive, other techniques must be used for getting this gas to market.

A commonly used technique for non-pipeline transport of gas involves liquefying the gas at or near the production site and then transporting the liquefied natural gas to market in specially designed storage tanks aboard transport vessels. The natural gas is cooled and condensed to a liquid state to produce liquefied natural gas ("LNG") at substantially atmospheric pressure and at temperatures of about −162° C. (−260° F.), thereby significantly increasing the amount of gas that can be stored in a storage tank, which can be on-site or aboard a transport vessel.

Many natural gas liquefaction facilities use a mixed refrigerant subsystem for pre-cooling, liquefaction, and sub-cooling natural gas to manufacture liquefied natural gas (LNG). Mixed refrigerants typically include a mixture of nitrogen and light hydrocarbons (e.g., methane, ethane, propane, and butane). In remote locations or where the natural gas supply does not contain significant quantities of the relatively-heavier light hydrocarbons (e.g., ethane and heavier), the relatively-heavier light hydrocarbons may need to be imported to the natural gas liquefaction facility, which has purchase and transport costs.

The relatively-heavier light hydrocarbons are volatile, so loss of these compounds from the mixed refrigerant is an issue. Relatively-heavier light hydrocarbon loss can be significant when portions of the natural gas liquefaction facility are shutdown (e.g., for planned maintenance or unplanned reasons). The mixed refrigerant being used in components of the natural gas liquefaction facility warms and increase in pressure, so some or all of the mixed refrigerant in that portion of the natural gas liquefaction facility is drained to mitigate over-pressurization and potential explosion. Often the drained mixed refrigerant is vented and flared. Then, when the portion of the natural gas liquefaction facility is brought back online, mixed refrigerant from storage is used to make up for the amount of vented and flared refrigerant. Alternate methods that conserve mixed refrigerant during facility shutdown provide an opportunity for significant cost savings.

SUMMARY

This disclosure relates generally to systems and methods for conserving mixed refrigerant during drain down operations of a refrigerant distribution subsystem in a natural gas liquefaction facility.

A method of operating, during an at least partial shutdown of a refrigerant distribution subsystem in a natural gas liquefaction facility, can comprise: draining down at least a portion of a mixed refrigerant in one or more components of the refrigerant distribution subsystem into a high-pressure holding tank of a drain down subsystem, wherein draining down to the high-pressure holding tank is achieved by pumping the mixed refrigerant from the refrigerant distribution subsystem to the high-pressure holding tank or backfilling the refrigerant distribution subsystem with a backfill gas; and optionally, transferring at least a portion of the mixed refrigerant into a low-pressure drum from the high-pressure holding tank.

A natural gas liquefaction facility can comprise: a refrigerant distribution subsystem that contains a mixed refrigerant; and a drain down subsystem that comprises a pump, a high-pressure holding tank, a low-pressure drum, and a valve separating the high-pressure holding tank from the low-pressure drum; wherein a plurality of valves separate the refrigerant distribution subsystem and the drain down subsystem; and wherein in a drain down mode the pump transports at least a portion of the mixed refrigerant from the refrigerant distribution subsystem to the high-pressure holding tank, and, when needed, mixed refrigerant from the high-pressure holding tank is allowed to enter the low-pressure drum via the valve.

A natural gas liquefaction facility can comprise: a refrigerant distribution subsystem that contains a mixed refrigerant; a drain down subsystem that comprises a high-pressure holding tank, a low-pressure drum, and a valve separating the high-pressure holding tank from the low-pressure drum, wherein a pressure in the high-pressure holding tank is lower than the mixed refrigerant in the refrigerant distribution subsystem; and a backfill subsystem that contains a backfill gas at a higher pressure than the mixed refrigerant in the refrigerant distribution subsystem; wherein a plurality of first valves separate the refrigerant distribution subsystem and the drain down subsystem; wherein a plurality of second valves separate the refrigerant distribution subsystem and the backfill subsystem; wherein in a drain down mode (a) at least a portion of the mixed refrigerant from the refrigerant distribution subsystem transports to the high-pressure holding tank via a pressure drop across at least one of the plurality of first valves, (b) at least a portion of the backfill gas from the backfill subsystem transports to the refrigerant distribution subsystem via a pressure drop across at least one of the plurality of first valves, and, (c) when needed, mixed refrigerant from the high-pressure holding tank is allowed to enter the low-pressure drum via the valve.

A method of operating, during an at least partial shutdown of a refrigerant distribution subsystem in a natural gas liquefaction facility, can comprise: draining down at least a portion of a mixed refrigerant in one or more components of the refrigerant distribution subsystem into a low-pressure drum of a drain down subsystem; and backfilling the refrigerant distribution subsystem with a backfill gas from a backfill subsystem; wherein a pressure in the refrigerant distribution subsystem is higher than a pressure in the low-pressure drum, and wherein the pressure in the refrigerant distribution subsystem is lower than a pressure of the backfill gas in the backfill subsystem.

A natural gas liquefaction facility can comprise: a refrigerant distribution subsystem that contains a mixed refrigerant; a drain down subsystem that comprises a low-pressure drum, wherein a pressure in the low-pressure drum is lower than the mixed refrigerant in the refrigerant distribution subsystem; and a backfill subsystem that contains a backfill gas at a higher pressure than the mixed refrigerant in the refrigerant distribution subsystem; wherein a plurality of first valves separate the refrigerant distribution subsystem and the drain down subsystem; wherein a plurality of second valves separate the refrigerant distribution subsystem and the backfill subsystem; and wherein in a drain down mode (a) at least a portion of the mixed refrigerant from the refrigerant distribution subsystem transports to the low-pressure drum 318 via a pressure drop across at least one of the plurality of first valves and (b) at least a portion of the backfill gas from the backfill subsystem transports to the refrigerant distribution subsystem via a pressure drop across at least one of the plurality of first valves.

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

This disclosure relates generally to systems and methods for conserving mixed refrigerant during drain down operations of a refrigerant distribution subsystem in a natural gas liquefaction facility.

Figure 1:
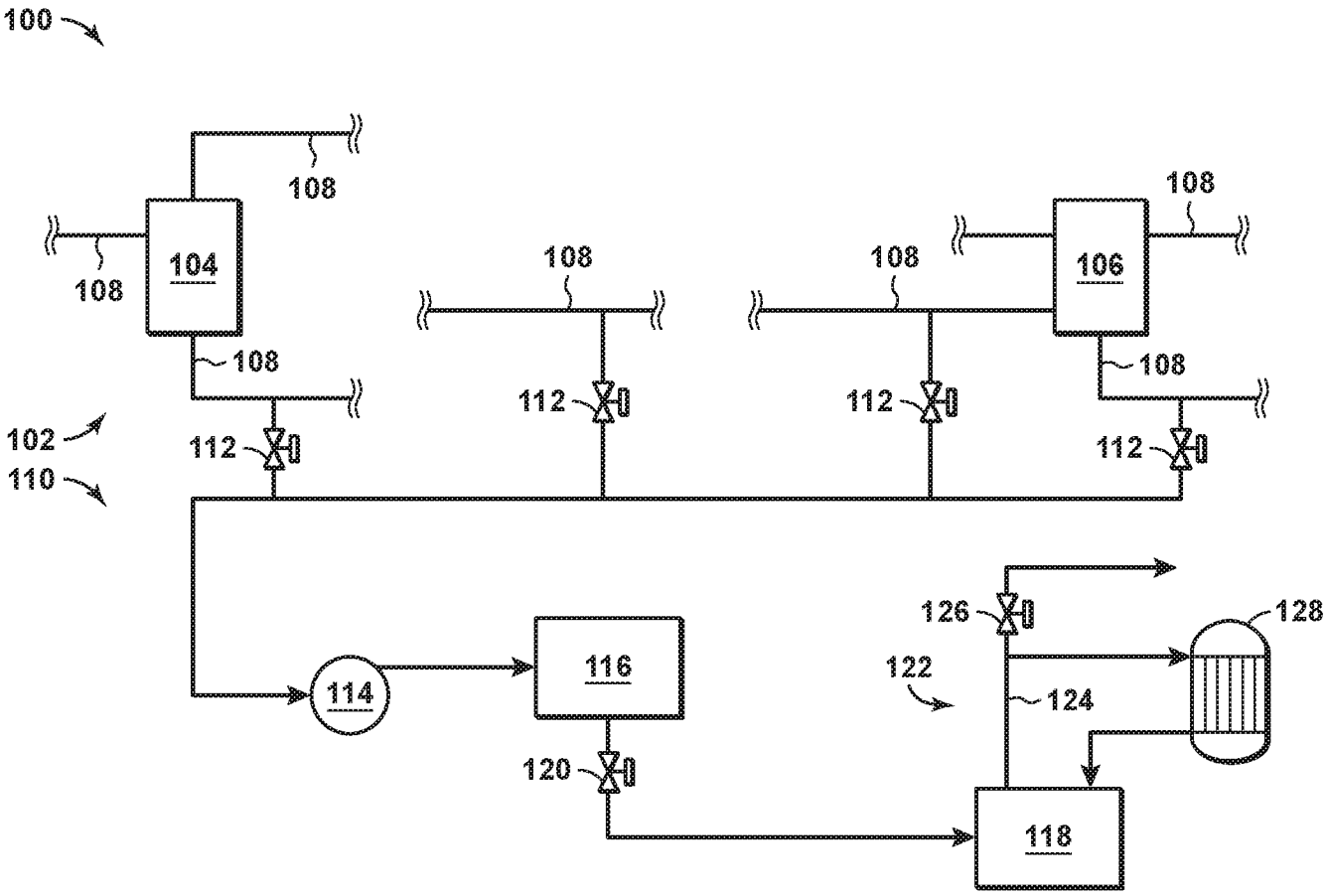
FIG. 1 is an illustrative diagram of a portion of a natural gas liquefaction facility for conserving refrigerant during a drain down of a refrigerant distribution subsystem by implementing a first drain down subsystem of the present invention.

FIG. 1 is an illustrative diagram of a portion 100 of a natural gas liquefaction facility. The portion 100 of the natural gas liquefaction facility includes a refrigerant distribution subsystem 102 that maintains the mixed refrigerant at the desired temperatures and pressures and distributes the mixed refrigerant to components of the natural gas liquefaction facility. The illustrated components of the refrigerant distribution subsystem 102 include a separator or drum 104, a liquefaction heat exchanger 106, and distribution lines 108. One skilled in the art will recognize other components that can or should be included in the refrigerant distribution subsystem 102 for proper and safe operation. Examples of components can include, but not limited to, additional heat exchangers (e.g., for pre-cooling and sub-cooling), condensers, compressors, pumps, valves, and the like. Nonlimiting examples of refrigerant distribution subsystems or portions thereof can be found in U. S. Patent Application Publication Nos. 2016/0040928, 2017/0097188, 2017/0167788, and 2018/0149424, each of which are incorporated herein by reference.

Inert gases, light hydrocarbons, and fluorocarbons can be used as components in a mixed refrigerant. Examples of components suitable for use in a mixed refrigerant include, but are not limited to, nitrogen, argon, krypton, xenon, carbon dioxide, natural gas, methane, ethane, ethylene, propane, propylene, tetrafluoro methane, trifluoro methane, fluoro methane, difluoro methane, octafluoro propane, 1,1,1,2,3,3,3-heptafluoro propane, 1,1,1,3,3-pentafluoro propane, hexafluoro ethane, 1,1,1,2,2 pentafluoro ethane, 1,1,1-trifluoro ethane, 2,3,3,3-tetrafluoropropene, 1,1,1,2-tetrafluoro ethane, 1,1difluoro ethane, 1,3,3,3-tetrafluoropropene, octafluoro cyclobutane, 1,1,1,3,3,3-hexafluoro propane, 1,1,2,2,3-pentafluoro propane, heptafluoropropyl, methyl ether, and the like. Specific examples of mixed refrigerants include, but are not limited to, propane and methane; propylene and methane; propane and propylene; propylene and propane; propane and ethane; propylene and ethane; propane and ethylene; propylene and ethylene; nitrogen and natural gas; tetrafluoro methane, trifluoro methane, difluoro methane, 1,1,1,2,3,3,3-heptafluoro propane, and 1,1,1,2,2 pentafluoro ethane; and the like.

The pressure of the mixed refrigerant in the various components of the refrigerant distribution subsystem 102 is dependent on the composition of the mixed refrigerant and the temperature of the mixed refrigerant. Typically, the temperature of the mixed refrigerant is maintained at about −175° C. and about −25° C. The pressure of the mixed refrigerant is maintained at about 2 bar absolute (bara) to about 25 bara, more typically about 5 bara to about 25 bara. One skilled in the art will recognize proper and safe operating temperatures and pressures for the various components of a refrigerant distribution subsystem depending on the mixed refrigerant composition and design of the refrigerant distribution subsystem.

The illustrated portion 100 of the natural gas liquefaction facility also includes a drain down subsystem 110. As illustrated, a plurality of valves 112 separate the refrigerant distribution subsystem 102 and the drain down subsystem 110. The illustrated drain down subsystem 110 includes a pump 114, a high-pressure holding tank 116, a low-pressure drum 118, a valve 120 separating the high-pressure holding tank 116 from the low-pressure drum 118, and optionally a condenser/flare subsystem 122 associated with the low-pressure drum 118. In alternative of the condenser/flare subsystem 122, a simple vent to flare (not illustrated) can be included.

In operation, during a shutdown or partial shutdown, (referred to herein as "drain down mode") the temperature of the mixed refrigerant in the refrigerant distribution subsystem 102 will increase, which increases the mixed refrigerant pressure. To avoid over-pressurization and potential explosion, the refrigerant distribution subsystem 102 can be at least partially drained down. When draining down, the valves 112 allow at least a portion of the mixed refrigerant in one or more of the components of the refrigerant distribution subsystem 102 to flow into the drain down subsystem 110. The pump 114 transfers the mixed refrigerant at high-pressure to the high-pressure holding tank 116. The high-pressure holding tank 116 stores and maintains the mixed refrigerant at suitable safe pressures (e.g., about 5 bara to about 25 bara) and temperatures (about −175° C. and about −100° C.).

As the temperature rises in the high-pressure holding tank 116 and/or the high-pressure holding tank 116 is at capacity, the mixed refrigerant in the high-pressure holding tank 116 can be drained to the low-pressure drum 118. The valve 120 and any other suitable components of the drain down subsystem 110 allow the high-pressure holding tank 116 and the low-pressure drum 118 to operate at different pressures. The low-pressure drum 118 stores and maintains the mixed refrigerant at suitable safe pressures (e.g., atmospheric pressure to about 2 bara) and temperatures (about −125° C. and about −25° C.).

In the low-pressure drum 118, the most volatile components (e.g., nitrogen and methane) of the mixed refrigerant evaporate from the mixed refrigerant in the low-pressure drum 118. The volatilized components pass through vent line 124 to either (a) a pressure valve 126 and then to flare or (b) a condenser 128 where the volatilized components are condensed and added back to the mixed refrigerant in the low-pressure drum 118.

One skilled in the art will recognize proper and safe operating temperatures and pressures for the various components of a drain down subsystem depending on the mixed refrigerant composition and design of the drain down subsystem.

Once the refrigerant distribution subsystem 102 is ready to be put back online, the mixed refrigerant in the high-pressure holding tank 116 and the low-pressure drum 118 can be added back into the refrigerant distribution subsystem 102. The component of the mixed refrigerant lost during the shutdown can be added back to the mixed refrigerant for proper and safe operation of the refrigerant distribution subsystem 102 when back online.

To briefly summarize FIG. 1, a natural gas liquefaction facility can comprise: a refrigerant distribution subsystem 102 that contains a mixed refrigerant; and a drain down subsystem 110 that comprises a pump 114, a high-pressure holding tank 116, a low-pressure drum 118, and a valve 120 separating the high-pressure holding tank 116 from the low-pressure drum 118; wherein a plurality of valves 112 separate the refrigerant distribution subsystem 102 and the drain down subsystem 110; and wherein in a drain down mode the pump 114 transports at least a portion of the mixed refrigerant from the refrigerant distribution subsystem 102 to the high-pressure holding tank 116, and, when needed, mixed refrigerant from the high-pressure holding tank 116 is allowed to enter the low-pressure drum 118 via the valve 120.

As used herein, when describing a line that fluidly connects two components, the line is used as a general term to encompass the line or lines that fluidly connect the two components and the other hardware like pumps, connectors, heat exchangers, and valves that may be installed along the line.

Figure 2:
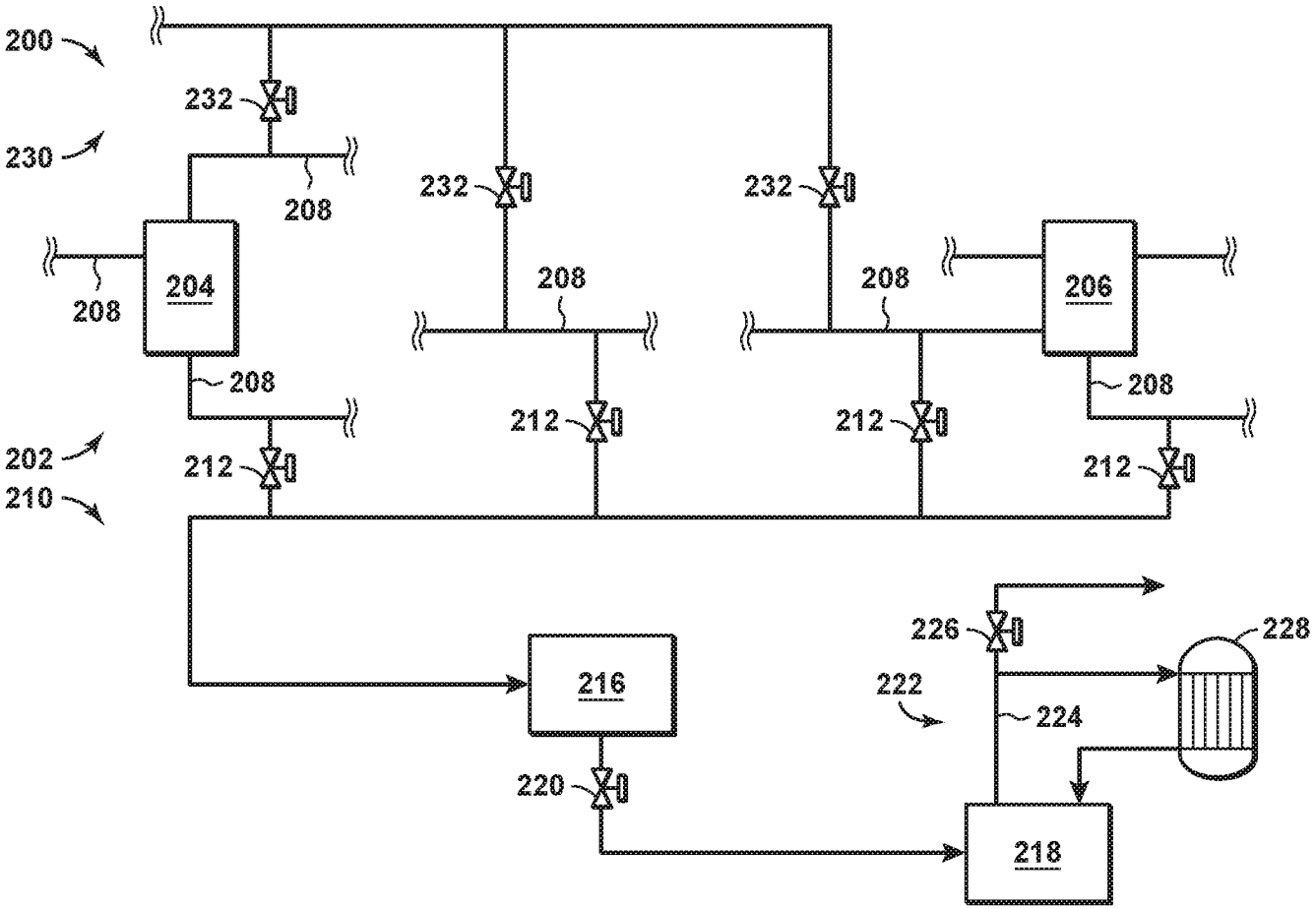
FIG. 2 is an illustrative diagram of a portion of a natural gas liquefaction facility for conserving refrigerant during a drain down of a refrigerant distribution subsystem by implementing a second drain down subsystem of the present invention.

FIG. 2 is an illustrative diagram of a portion 200 of a natural gas liquefaction facility. The portion 200 of the natural gas liquefaction facility includes a refrigerant distribution subsystem 202 that maintains the mixed refrigerant at the desired temperatures and pressures and distributes the mixed refrigerant to components of the natural gas liquefaction facility. The illustrated components of the refrigerant distribution subsystem 202 include a separator or drum 204, a liquefaction heat exchanger 206, and distribution lines 208. One skilled in the art will recognize other components that can or should be included in the refrigerant distribution subsystem 202 for proper and safe operation. Examples of components can include, but not limited to, additional heat exchangers (e.g., for pre-cooling and sub-cooling), condensers, compressors, pumps, valves, and the like. Nonlimiting examples of refrigerant distribution subsystems or portions thereof can be found in U. S. Patent Application Publication Nos. 2016/0040928, 2017/0097188, 2017/0167788, and 2018/0149424, each of which are incorporated herein by reference.

The pressure of the mixed refrigerant in the various components of the refrigerant distribution subsystem 202 is dependent on the composition of the mixed refrigerant and the temperature of the mixed refrigerant. Typically, the temperature of the mixed refrigerant is maintained at about −175° C. and about −25° C. The pressure of the mixed refrigerant is maintained at about 2 bara to about 25 bara, more typically about 5 bara to about 25 bara. One skilled in the art will recognize proper and safe operating temperatures and pressures for the various components of a refrigerant distribution subsystem depending on the mixed refrigerant composition and design of the refrigerant distribution subsystem.

The illustrated portion 200 of the natural gas liquefaction facility also includes a drain down subsystem 210. As illustrated, a plurality of valves 212 separate the refrigerant distribution subsystem 202 and the drain down subsystem 210. The illustrated drain down subsystem 210 includes a high-pressure holding tank 216, a low-pressure drum 218, a valve 220 separating the high-pressure holding tank 216 from the low-pressure drum 218, and optionally a condenser/flare subsystem 222 associated with the low-pressure drum 218. In alternative of the condenser/flare subsystem 222, a simple vent to flare (not illustrated) can be included.

The illustrated portion 200 of the natural gas liquefaction facility also includes a backfill subsystem 230. As illustrated, a plurality of valves 232 separate the refrigerant distribution subsystem 202 and the backfill subsystem 230.

In drain down mode, the temperature of the mixed refrigerant in the refrigerant distribution subsystem 202 will increase, which increases the mixed refrigerant pressure. To avoid over-pressurization and potential explosion, the refrigerant distribution subsystem 202 can be at least partially drained down. When draining down, the valves 212 allow at least a portion of the mixed refrigerant in one or more of the components of the refrigerant distribution subsystem 202 to flow into the high-pressure holding tank 216 of the drain down subsystem 210. The high-pressure holding tank 216 is maintained at a lower pressure than the refrigerant distribution subsystem 202 to achieve transport of the mixed refrigerant to the high-pressure holding tank 216.

To maintain the refrigerant distribution subsystem 202 at a higher pressure than the high-pressure holding tank 216, the backfill subsystem 230 adds a backfill gas to the refrigerant distribution subsystem 202. The backfill gas is typically dry natural gas, nitrogen, or a mixture thereof. The backfill subsystem 230 stores and maintains the backfill gas at suitable safe pressures (e.g., about 5 bara to about 35 bara) and temperatures (about −175° C. and about −100° C.).

The high-pressure holding tank 216 stores and maintains the mixed refrigerant at suitable safe pressures (e.g., about 5 bara to about 25 bara) and temperatures (about −175° C. and about −100° C.).

As the temperature rises in the high-pressure holding tank 216 and/or the high-pressure holding tank 216 is at capacity, the mixed refrigerant in the high-pressure holding tank 216 can be drained to the low-pressure drum 218. The valve 220 and any other suitable components of the drain down subsystem 210 allow the high-pressure holding tank 216 and the low-pressure drum 218 to operate at different pressures. The low-pressure drum 218 stores and maintains the mixed refrigerant at suitable safe pressures (e.g., atmospheric pressure to about 2 bara) and temperatures (about −125° C. and about −25° C.).

In the low-pressure drum 218, the most volatile components (e.g., nitrogen and methane) of the mixed refrigerant evaporate from the mixed refrigerant in the low-pressure drum 218. The volatilized components pass through vent line 224 to either (a) a pressure valve 226 and then to flare or (b) a condenser 228 where the volatilized components are condensed and added back to the mixed refrigerant in the low-pressure drum 218.

In this illustrated portion 200 of the natural gas liquefaction facility, fluid pressure is used to transfer fluids between subsystems and between components of the drain down subsystem 210. Therefore, the backfill subsystem 230 is at a higher pressure than the refrigerant distribution subsystem 202, the refrigerant distribution subsystem 202 is at a higher pressure than the high-pressure holding tank 216, and the high-pressure holding tank 216 is at a higher pressure than the low-pressure drum 218. Pressure drops as described can lead to Joule-Thompson cooling of the mixed refrigerant, which reduces the cost associated with keeping each subsystem and components thereof cooled.

One skilled in the art will recognize proper and safe operating temperatures and pressures for the various components of a drain down subsystem depending on the mixed refrigerant composition and design of the drain down subsystem.

Once the refrigerant distribution subsystem 202 is ready to be put back online, the mixed refrigerant in the high-pressure holding tank 216 and the low-pressure drum 218 can be added back into the refrigerant distribution subsystem 202. The composition of the mixed refrigerant will likely change during the drain down process because of volatilized components and mixing with backfill gas. Therefore, various components of the mixed refrigerant can be added to the mixed refrigerant to get the proper composition and ensure proper and safe operation of the refrigerant distribution subsystem 202 when back online.

With reference to FIGS. 1 and 2, a method of operating, during an at least partial shutdown of a refrigerant distribution subsystem 102, 202 in a natural gas liquefaction facility, can include: draining down at least a portion of a mixed refrigerant in one or more components of the refrigerant distribution subsystem 102, 202 into a high-pressure holding tank 116, 216 of a drain down subsystem 110, 210, wherein draining down to the high-pressure holding tank 116, 216 is achieved by (a) pumping the mixed refrigerant from the refrigerant distribution subsystem 102, 202 to the high-pressure holding tank 116, 216 or (b) backfilling the refrigerant distribution subsystem 102, 202 with a backfill gas; and optionally, transferring at least a portion of the mixed refrigerant into a low-pressure drum 118, 218 from the high-pressure holding tank 116, 216.

To briefly summarize FIG. 2, a natural gas liquefaction facility can comprise: a refrigerant distribution subsystem 202 that contains a mixed refrigerant; a drain down subsystem 210 that comprises a high-pressure holding tank 216, a low-pressure drum 218, and a valve 220 separating the high-pressure holding tank 216 from the low-pressure drum 218, wherein a pressure in the high-pressure holding tank 216 is lower than the mixed refrigerant in the refrigerant distribution subsystem 202; a backfill subsystem 230 that contains a backfill gas at a higher pressure than the mixed refrigerant in the refrigerant distribution subsystem 202; wherein a plurality of first valves 212 separate the refrigerant distribution subsystem 202 and the drain down subsystem 210; wherein a plurality of second valves 232 separate the refrigerant distribution subsystem 202 and the backfill subsystem 230; wherein in a drain down mode (a) at least a portion of the mixed refrigerant from the refrigerant distribution subsystem 202 transports to the high-pressure holding tank 216 via a pressure drop across at least one of the plurality of first valves 212, (b) at least a portion of the backfill gas from the backfill subsystem 230 transports to the refrigerant distribution subsystem 202 via a pressure drop across at least one of the plurality of first valves 232, and, (c) when needed, mixed refrigerant from the high-pressure holding tank 216 is allowed to enter the low-pressure drum 218 via the valve 220.

Figure 3:
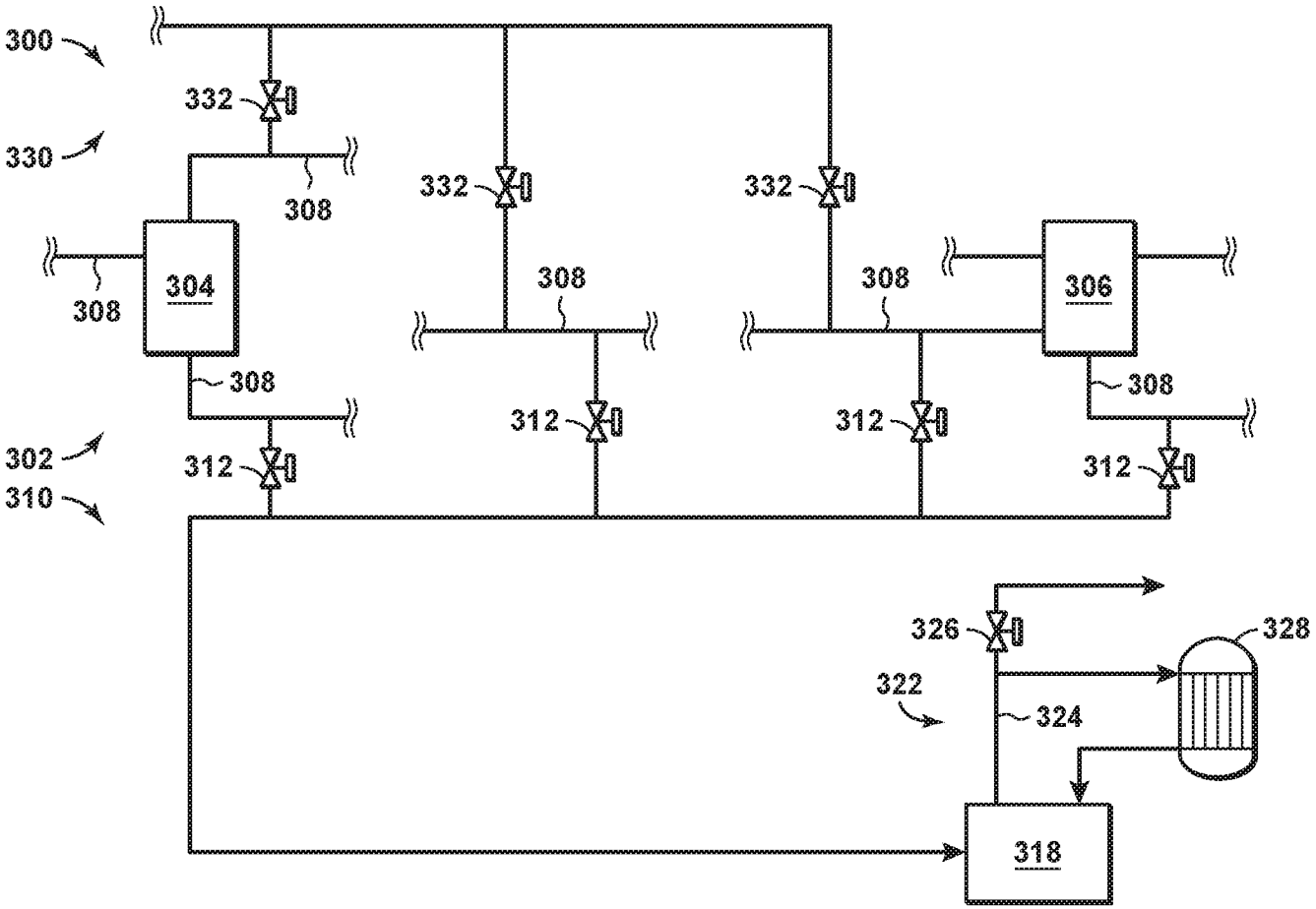
FIG. 3 is an illustrative diagram of a portion of a natural gas liquefaction facility for conserving refrigerant during a drain down of a refrigerant distribution subsystem by implementing a third drain down subsystem of the present invention.

FIG. 3 is an illustrative diagram of a portion 300 of a natural gas liquefaction facility. The portion 300 of the natural gas liquefaction facility includes a refrigerant distribution subsystem 302 that maintains the mixed refrigerant at the desired temperatures and pressures and distributes the mixed refrigerant to components of the natural gas liquefaction facility. The illustrated components of the refrigerant distribution subsystem 302 include a separator or drum 304, a liquefaction heat exchanger 306, and distribution lines 308. One skilled in the art will recognize other components that can or should be included in the refrigerant distribution subsystem 302 for proper and safe operation. Examples of components can include, but not limited to, additional heat exchangers (e.g., for pre-cooling and sub-cooling), condensers, compressors, pumps, valves, and the like. Nonlimiting examples of refrigerant distribution subsystems or portions thereof can be found in U. S. Patent Application Publication Nos. 2016/0040928, 2017/0097188, 2017/0167788, and 2018/0149424, each of which are incorporated herein by reference.

The pressure of the mixed refrigerant in the various components of the refrigerant distribution subsystem 302 is dependent on the composition of the mixed refrigerant and the temperature of the mixed refrigerant. Typically, the temperature of the mixed refrigerant is maintained at about −175° C. and about −25° C. The pressure of the mixed refrigerant is maintained at about 2 bara to about 25 bara, more typically about 5 bara to about 25 bara. One skilled in the art will recognize proper and safe operating temperatures and pressures for the various components of a refrigerant distribution subsystem depending on the mixed refrigerant composition and design of the refrigerant distribution subsystem.

The illustrated portion 300 of the natural gas liquefaction facility also includes a drain down subsystem 310. As illustrated, a plurality of valves 312 separate the refrigerant distribution subsystem 302 and the drain down subsystem 310. The illustrated drain down subsystem 310 includes a low-pressure drum 318 and optionally a condenser/flare subsystem 322 associated with the low-pressure drum 318. In alternative of the condenser/flare subsystem 322, a simple vent to flare (not illustrated) can be included.

The illustrated portion 300 of the natural gas liquefaction facility also includes a backfill subsystem 330. As illustrated, a plurality of valves 332 separate the refrigerant distribution subsystem 302 and the backfill subsystem 330.

In drain down mode, the temperature of the mixed refrigerant in the refrigerant distribution subsystem 302 will increase, which increases the mixed refrigerant pressure. To avoid over-pressurization and potential explosion, the refrigerant distribution subsystem 302 can be at least partially drained down. When draining down, the valves 312 allow at least a portion of the mixed refrigerant in one or more of the components of the refrigerant distribution subsystem 302 to flow into the low-pressure drum 318 of the drain down subsystem 310. The low-pressure drum 318 is maintained at a lower pressure than the refrigerant distribution subsystem 302 to achieve transport of the mixed refrigerant to the low-pressure drum 318.

To maintain the refrigerant distribution subsystem 302 at a higher pressure than the low-pressure drum 318, the backfill subsystem 330 adds a backfill gas to the refrigerant distribution subsystem 302. The backfill gas is typically dry natural gas, nitrogen, or a mixture thereof. The backfill subsystem 330 stores and maintains the backfill gas at suitable safe pressures (e.g., about 5 bara to about 36 bara) and temperatures (about −175° C. and about −100° C.).

The low-pressure drum 318 stores and maintains the mixed refrigerant at suitable safe pressures (e.g., atmospheric pressure to about 2 bara) and temperatures (about −125° C. and about −25° C.).

In the low-pressure drum 318, the most volatile components (e.g., nitrogen and methane) of the mixed refrigerant evaporate from the mixed refrigerant in the low-pressure drum 318. The volatilized components pass through vent line 324 to either (a) a pressure valve 326 and then to flare or (b) a condenser 328 where the volatilized components are condensed and added back to the mixed refrigerant in the low-pressure drum 318.

In this illustrated portion 300 of the natural gas liquefaction facility, fluid pressure is used to transfer fluids between subsystems and between components of the drain down subsystem 310. Therefore, the backfill subsystem 330 is at a higher pressure than the refrigerant distribution subsystem 302, and the refrigerant distribution subsystem 302 is at a higher pressure than the low-pressure drum 318. Pressure drops as described can lead to Joule-Thompson cooling of the mixed refrigerant, which reduces the cost associated with keeping each subsystem and components thereof cooled. This is most prominent in the transfer of mixed refrigerant from the refrigerant distribution subsystem 302 to the low-pressure drum 318.

One skilled in the art will recognize proper and safe operating temperatures and pressures for the various components of a drain down subsystem depending on the mixed refrigerant composition and design of the drain down subsystem.

Once the refrigerant distribution subsystem 302 is ready to be put back online, the mixed refrigerant in the low-pressure drum 318 can be added back into the refrigerant distribution subsystem 302. The composition of the mixed refrigerant will likely change during the drain down process because of volatilized components and mixing with backfill gas. Therefore, various components of the mixed refrigerant can be added to the mixed refrigerant to get the proper composition and ensure proper and safe operation of the refrigerant distribution subsystem 302 when back online.

To briefly summarize FIG. 3, a natural gas liquefaction facility can comprise: a refrigerant distribution subsystem 302 that contains a mixed refrigerant; a drain down subsystem 310 that comprises a low-pressure drum 318, wherein a pressure in the low-pressure drum 318 is lower than the mixed refrigerant in the refrigerant distribution subsystem 302; a backfill subsystem 330 that contains a backfill gas at a higher pressure than the mixed refrigerant in the refrigerant distribution subsystem 302; wherein a plurality of first valves 312 separate the refrigerant distribution subsystem 302 and the drain down subsystem 310; wherein a plurality of second valves 332 separate the refrigerant distribution subsystem 302 and the backfill subsystem 330; wherein in a drain down mode (a) at least a portion of the mixed refrigerant from the refrigerant distribution subsystem 302 transports to the low-pressure drum 318 via a pressure drop across at least one of the plurality of first valves 312 and (b) at least a portion of the backfill gas from the backfill subsystem 330 transports to the refrigerant distribution subsystem 302 via a pressure drop across at least one of the plurality of first valves 332.

With reference to FIG. 3, a method of operating, during an at least partial shutdown of a refrigerant distribution subsystem 302 in a natural gas liquefaction facility, can include: draining down at least a portion of a mixed refrigerant in one or more components of the refrigerant distribution subsystem 302 into a low-pressure drum 318 of a drain down subsystem 310, wherein a pressure in the refrigerant distribution subsystem 302 is higher than a pressure in the low-pressure drum 318, and wherein the pressure in the refrigerant distribution subsystem 302 is maintained at the higher pressure by backfilling the refrigerant distribution subsystem 302 with a backfill gas.

EXAMPLES

Example 1 is a method of operating, during an at least partial shutdown of a refrigerant distribution subsystem in a natural gas liquefaction facility, comprising: draining down at least a portion of a mixed refrigerant in one or more components of the refrigerant distribution subsystem into a high-pressure holding tank of a drain down subsystem, wherein draining down to the high-pressure holding tank is achieved by pumping the mixed refrigerant from the refrigerant distribution subsystem to the high-pressure holding tank or backfilling the refrigerant distribution subsystem with a backfill gas; and optionally, transferring at least a portion of the mixed refrigerant into a low-pressure drum from the high-pressure holding tank.

Example 2: Optionally, Example 1 can further comprise: returning the portion of the mixed refrigerant in the high-pressure refrigerant holding drum to the refrigerant distribution subsystem.

Example 3: Optionally, Example 1 and/or 2 can further comprise: returning the portion of the refrigerant in the low-pressure refrigerant holding drum to the refrigerant distribution subsystem.

Example 4: Optionally, one or more of Examples 1-3 can be performed wherein the mixed refrigerant in the refrigerant distribution subsystem is at a pressure of about 2 bara to about 25 bara and a temperature of about −175° C. to about −25° C.

Example 5: Optionally, one or more of Examples 1-4 can be performed wherein the mixed refrigerant in the high-pressure holding tank is at a pressure of about 5 bara to about 25 bara and a temperature of about −175° C. to about −100° C.

Example 6: Optionally, one or more of Examples 1-5 can be performed wherein the mixed refrigerant in the low-pressure drum is at a pressure of atmospheric pressure to about 2 bara and a temperature of about −125° C. to about −25° C.

Example 7: Optionally, one or more of Examples 1-6 can be performed wherein draining down to the high-pressure holding tank is achieved by (b) backfilling the refrigerant distribution subsystem with a backfill gas, wherein a pressure of the backfill gas prior to backfilling into the refrigerant distribution subsystem is higher than a pressure of the mixed refrigerant in the refrigerant distribution subsystem, and wherein the pressure of the mixed refrigerant in the refrigerant distribution subsystem is greater than a pressure of the mixed refrigerant in the high-pressure holding tank.

Example 8: Optionally, one or more of Examples 1-7 can be performed wherein the refrigerant is a mixture comprising methane, ethane, propane, butane, and optionally nitrogen.

Example 9: Optionally, one or more of Examples 1-8 can be performed wherein the low-pressure refrigerant holding drum has a vent coupled to a condenser.

Example 10 is a natural gas liquefaction facility comprising: a refrigerant distribution subsystem that contains a mixed refrigerant; and a drain down subsystem that comprises a pump, a high-pressure holding tank, a low-pressure drum, and a valve separating the high-pressure holding tank from the low-pressure drum; wherein a plurality of valves separate the refrigerant distribution subsystem and the drain down subsystem; and wherein in a drain down mode the pump transports at least a portion of the mixed refrigerant from the refrigerant distribution subsystem to the high-pressure holding tank, and, when needed, mixed refrigerant from the high-pressure holding tank is allowed to enter the low-pressure drum via the valve.

Example 11 is a natural gas liquefaction facility comprising: a refrigerant distribution subsystem that contains a mixed refrigerant; a drain down subsystem that comprises a high-pressure holding tank, a low-pressure drum, and a valve separating the high-pressure holding tank from the low-pressure drum, wherein a pressure in the high-pressure holding tank is lower than the mixed refrigerant in the refrigerant distribution subsystem; and a backfill subsystem that contains a backfill gas at a higher pressure than the mixed refrigerant in the refrigerant distribution subsystem; wherein a plurality of first valves separate the refrigerant distribution subsystem and the drain down subsystem; wherein a plurality of second valves separate the refrigerant distribution subsystem and the backfill subsystem; wherein in a drain down mode (a) at least a portion of the mixed refrigerant from the refrigerant distribution subsystem transports to the high-pressure holding tank via a pressure drop across at least one of the plurality of first valves, (b) at least a portion of the backfill gas from the backfill subsystem transports to the refrigerant distribution subsystem via a pressure drop across at least one of the plurality of first valves, and, (c) when needed, mixed refrigerant from the high-pressure holding tank is allowed to enter the low-pressure drum via the valve.

Example 12: Optionally, Example 10 and/or 11 can further comprise: a subsystem for returning the portion of the mixed refrigerant in the high-pressure refrigerant holding drum to the refrigerant distribution subsystem.

Example 13: Optionally, one or more of Examples 10-12 can further comprise: a subsystem for returning the portion of the refrigerant in the low-pressure refrigerant holding drum to the refrigerant distribution subsystem.

Example 14: Optionally, one or more of Examples 10-13 can be configured wherein the mixed refrigerant in the refrigerant distribution subsystem is at a pressure of about 2 bara to about 25 bara and a temperature of about −175° C. to about −25° C.

Example 15: Optionally, one or more of Examples 10-14 can be configured wherein the mixed refrigerant in the high-pressure holding tank is at a pressure of about 5 bara to about 25 bara and a temperature of about −175° C. to about −100° C.

Example 16: Optionally, one or more of Examples 10-15 can be configured wherein the mixed refrigerant in the low-pressure drum is at a pressure of atmospheric pressure to about 2 bara and a temperature of about −125° C. to about −25° C.

Example 17: Optionally, one or more of Examples 11-16 can be configured wherein the backfill gas in the backfill subsystem is at about 5 bara to about 35 bara and a temperature of about −175° C. to about −100° C.

Example 18: Optionally, one or more of Examples 11-17 can be configured wherein a pressure of the backfill gas prior to backfilling into the refrigerant distribution subsystem is higher than a pressure of the mixed refrigerant in the refrigerant distribution subsystem, and wherein the pressure of the mixed refrigerant in the refrigerant distribution subsystem is greater than a pressure of the mixed refrigerant in the high-pressure holding tank.

Example 19: Optionally, one or more of Examples 10-18 can be configured wherein the refrigerant is a mixture comprising methane, ethane, propane, butane, and optionally nitrogen.

Example 20: Optionally, one or more of Examples 10-19 can be configured wherein the low-pressure refrigerant holding drum has a vent coupled to a condenser.

Example 21 is a method of operating, during an at least partial shutdown of a refrigerant distribution subsystem in a natural gas liquefaction facility, comprising: draining down at least a portion of a mixed refrigerant in one or more components of the refrigerant distribution subsystem into a low-pressure drum of a drain down subsystem; and backfilling the refrigerant distribution subsystem with a backfill gas from a backfill subsystem; wherein a pressure in the refrigerant distribution subsystem is higher than a pressure in the low-pressure drum, and wherein the pressure in the refrigerant distribution subsystem is lower than a pressure of the backfill gas in the backfill subsystem.

Example 22: Optionally, Example 21 can further comprise: returning the portion of the mixed refrigerant in the high-pressure refrigerant holding drum to the refrigerant distribution subsystem.

Example 23: Optionally, Example 21 and/or 22 can further comprise: returning the portion of the refrigerant in the low-pressure refrigerant holding drum to the refrigerant distribution subsystem.

Example 24: Optionally, one or more of Examples 21-23 can be performed wherein the pressure of the backfill gas in the backfill subsystem is at about 5 bara to about 35 bara and a temperature of about −175° C. to about −100° C.

Example 25: Optionally, one or more of Examples 21-24 can be performed wherein the pressure in the refrigerant distribution subsystem is at about 2 bara to about 25 bara and a temperature of about −175° C. to about −25° C.

Example 26: Optionally, one or more of Examples 21-25 can be performed wherein the pressure in the low-pressure drum is at about atmospheric pressure to about 2 bara and a temperature of about −125° C. to about −25° C.

Example 27: Optionally, one or more of Examples 21-26 can be performed wherein the low-pressure refrigerant holding drum has a vent coupled to a condenser.

Example 28 is a natural gas liquefaction facility comprising: a refrigerant distribution subsystem that contains a mixed refrigerant; a drain down subsystem that comprises a low-pressure drum, wherein a pressure in the low-pressure drum is lower than the mixed refrigerant in the refrigerant distribution subsystem; and a backfill subsystem that contains a backfill gas at a higher pressure than the mixed refrigerant in the refrigerant distribution subsystem; wherein a plurality of first valves separate the refrigerant distribution subsystem and the drain down subsystem; wherein a plurality of second valves separate the refrigerant distribution subsystem and the backfill subsystem; and wherein in a drain down mode (a) at least a portion of the mixed refrigerant from the refrigerant distribution subsystem transports to the low-pressure drum 318 via a pressure drop across at least one of the plurality of first valves and (b) at least a portion of the backfill gas from the backfill subsystem transports to the refrigerant distribution subsystem via a pressure drop across at least one of the plurality of first valves.

Example 29: Optionally, Example 28 can further comprise: a subsystem for returning the portion of the mixed refrigerant in the high-pressure refrigerant holding drum to the refrigerant distribution subsystem.

Example 30: Optionally, Example 28 and/or 29 can further comprise: a subsystem for returning the portion of the refrigerant in the low-pressure refrigerant holding drum to the refrigerant distribution subsystem.

Example 31: Optionally, one or more of Examples 28-30 can be configured wherein the pressure of the backfill gas in the backfill subsystem is at about 5 bara to about 35 bara and a temperature of about −175° C. to about −100° C.

Example 32: Optionally, one or more of Examples 28-31 can be configured wherein the pressure in the refrigerant distribution subsystem is at about 2 bara to about 25 bara and a temperature of about −175° C. to about −25° C.

Example 33: Optionally, one or more of Examples 28-32 can be configured wherein the pressure in the low-pressure drum is at about atmospheric pressure to about 2 bara and a temperature of about −125° C. to about −25° C.

Example 34: Optionally, one or more of Examples 28-33 can be configured wherein the low-pressure refrigerant holding drum has a vent coupled to a condenser.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the embodiments of the present invention. At the very least, and not as an attempt to limit the application of the doctrine of equivalents to the scope of the claim, each numerical parameter should at least be construed in light of the number of reported significant digits and by applying ordinary rounding techniques.

One or more illustrative embodiments incorporating the invention embodiments disclosed herein are presented herein. Not all features of a physical implementation are described or shown in this application for the sake of clarity. It is understood that in the development of a physical embodiment incorporating the embodiments of the present invention, numerous implementation-specific decisions must be made to achieve the developer's goals, such as compliance with system-related, business-related, government-related and other constraints, which vary by implementation and from time to time. While a developer's efforts might be time-consuming, such efforts would be, nevertheless, a routine undertaking for those of ordinary skill in the art and having benefit of this disclosure.

While compositions and methods are described herein in terms of "comprising" various components or steps, the compositions and methods can also "consist essentially of" or "consist of" the various components and steps.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

The invention claimed is:

1. A method of operating, during an at least partial shutdown of a refrigerant distribution subsystem in a natural gas liquefaction facility, comprising:

draining down at least a portion of a mixed refrigerant in one or more components of the refrigerant distribution subsystem into a high-pressure holding tank of a drain down subsystem, wherein draining down to the high-pressure holding tank is achieved by pumping the mixed refrigerant from the refrigerant distribution subsystem to the high-pressure holding tank or backfilling the refrigerant distribution subsystem with a backfill gas; and transferring at least a portion of the mixed refrigerant into a low-pressure drum from the high-pressure holding tank, wherein the low-pressure refrigerant holding drum has a vent coupled to a condenser.

2. The method of claim 1, further comprising:

returning the portion of the mixed refrigerant in the high-pressure refrigerant holding drum to the refrigerant distribution subsystem.

3. The method of claim 1, further comprising:

returning the portion of the mixed refrigerant in the low-pressure refrigerant holding drum to the refrigerant distribution subsystem.

4. The method of claim 1, wherein the mixed refrigerant in the refrigerant distribution subsystem is at a pressure of about 2 bar absolute (bara) to about 25 bara and a temperature of about −175° C. to about −25° C.

5. The method of claim 1, wherein the mixed refrigerant in the high-pressure holding tank is at a pressure of about 5 bara to about 25 bara and a temperature of about −175° C. to about −100° C.

6. The method of claim 1, wherein the mixed refrigerant in the low-pressure drum is at a pressure of atmospheric pressure to about 2 bara and a temperature of about −125° C. to about −25° C.

7. The method of claim 1, wherein a pressure of the backfill gas prior to backfilling into the refrigerant distribution subsystem is higher than a pressure of the mixed refrigerant in the refrigerant distribution subsystem, and wherein the pressure of the mixed refrigerant in the refrigerant distribution subsystem is greater than a pressure of the mixed refrigerant in the high-pressure holding tank.

8. The method of claim 1, wherein the mixed refrigerant is a mixture comprising methane, ethane, propane, butane, and optionally nitrogen.

9. A method of operating, during an at least partial shutdown of a refrigerant distribution subsystem in a natural gas liquefaction facility, comprising:

draining down at least a portion of a mixed refrigerant in one or more components of the refrigerant distribution subsystem into a low-pressure drum of a drain down subsystem, wherein the low-pressure refrigerant holding drum has a vent coupled to a condenser; and backfilling the refrigerant distribution subsystem with a backfill gas from a backfill subsystem;

wherein a pressure in the refrigerant distribution subsystem is higher than a pressure in the low-pressure drum, and wherein the pressure in the refrigerant distribution subsystem is lower than a pressure of the backfill gas in the backfill subsystem.

10. The method of claim 9, further comprising:

returning the portion of the mixed refrigerant in the low-pressure refrigerant holding drum to the refrigerant distribution subsystem.

11. The method of claim 9, wherein the pressure of the backfill gas in the backfill subsystem is at about 5 bar absolute (bara) to about 35 bara and a temperature of about −175° C. to about −100° C.

12. The method of claim 9, wherein the pressure in the refrigerant distribution subsystem is at about 2 bara to about 25 bara and a temperature of about −175° C. to about −25° C.

13. The method of claim 9, wherein the pressure in the low-pressure drum is at about atmospheric pressure to about 2 bara and a temperature of about −125° C. to about −25° C.

* * * * *